US007070230B2

(12) United States Patent
Chen

(10) Patent No.: US 7,070,230 B2
(45) Date of Patent: Jul. 4, 2006

(54) COMBINATION OF ONE TABLE AND TWO CHAIRS FOR TWO PERSONS

(76) Inventor: Libin Chen, Qiaoyu Building, Boyi Town, Ximenwai, Changzhou, Jiangsu 213147, P.R. (CN)

( * ) Notice: Subject to any disclaimer, the term of this patent is extended or adjusted under 35 U.S.C. 154(b) by 74 days.

(21) Appl. No.: 10/829,815

(22) Filed: Apr. 21, 2004

(65) Prior Publication Data

US 2004/0207237 A1 Oct. 21, 2004

(30) Foreign Application Priority Data

Apr. 21, 2003 (CN) ..... 03221270

(51) Int. Cl.
*A47B 39/00* (2006.01)

(52) U.S. Cl. ..... 297/135; 297/16.2; 297/35; 297/42; 297/44

(58) Field of Classification Search ..... 297/16.2, 297/16.1, 35, 39, 42, 44, 45, 46, 56, 135, 297/173, 232
See application file for complete search history.

(56) References Cited

U.S. PATENT DOCUMENTS 5,570,928 A * 11/1996 Staunton et al. ..... 297/232
6,231,119 B1 * 5/2001 Zheng ..... 297/16.2
6,247,749 B1 * 6/2001 Yu ..... 297/16.2
6,302,479 B1 * 10/2001 Zheng ..... 297/16.2
6,454,348 B1 * 9/2002 Wu ..... 297/16.2
6,547,321 B1 * 4/2003 Wu ..... 297/16.1
6,634,609 B1 * 10/2003 Zheng ..... 248/277.1
6,682,135 B1 * 1/2004 Zheng ..... 297/16.2
6,926,356 B1 * 8/2005 Chen ..... 297/45

* cited by examiner

*Primary Examiner*—Laurie K. Cranmer
(74) *Attorney, Agent, or Firm*—Martine Penilla & Gencarella, LLP

(57) ABSTRACT

A combination of one table and two chairs for two persons includes two folding chairs and one folding table. Each of the folding chairs include arm tubes, front crossed tubes, back-rest tubes, seating frame tubes, rear crossed tubes, and a chair surface fabric. The folding table includes front vertical tubes, front crossed tubes, rear vertical tubes, rear crossed tubes, and a table surface fabric. The arm tubes are connected cross-wise to the front crossed tubes, and the crossed connection point is provided with a reinforced block. The seating frame tubes are connected cross-wise to the back-rest tubes, and the arm tubes are connected to the front ends of the seating frame tubes via U-shaped hinging elements. The upper portions of the rear crossed tubes are connected to the back-rest tubes, and the lower portions thereof are connected to the seating frame tubes.

7 Claims, 7 Drawing Sheets

COMBINATION OF ONE TABLE AND TWO CHAIRS FOR TWO PERSONS

FIELD OF THE INVENTION

This invention relates to a combination of one table and two chairs for two persons that is suitable for travel and leisure and that can be used outdoors, for example, in a courtyard, in a park, and at the beach.

BACKGROUND OF THE INVENTION

Folding chairs and tables for travel and other activities are usually provided separately. The use of separate folding chairs and tables for outdoor activities and travel is inconvenient because they occupy a large volume, either When folded or when unfolded.

SUMMARY OF THE INVENTION

The present invention provides a combination of one table and two chairs for two persons that overcomes the above mentioned defects, by combining two folding chairs and one folding table together into a compact structure, so that two persons can use the two chairs and share the one table simultaneously.

In one embodiment, a combination of one table and two chairs for two persons includes two folding chairs and one folding table. Each of the folding chairs include arm tubes, front crossed tubes, back-rest tubes, seating frame tubes, rear crossed tubes, and chair surface fabrics. The folding table includes front vertical tubes, front crossed tubes, rear vertical tubes, rear crossed tubes, and a table surface fabric. The front crossed tubes may be arranged in several groups: upper front crossed tubes; middle front crossed tubes; and lower front crossed tubes. The arm tubes are connected cross-wise to front crossed tubes, and the crossed connection point is provided with a pair of reinforced blocks. The seating frame tubes are connected cross-wise to the back-rest tubes, and the arm tubes are connected to the front ends of the seating frame tubes via U-shaped hinging elements. The upper portion of each of the rear crossed tubes is connected to one of the back-rest tubes, and the lower portion of each of the rear crossed tubes is connected to one of the seating frame tubes. The middle portions of the front vertical tubes are connected to the seating frame tubes and to the front crossed tubes, via sliding sleeves. The rear vertical tubes are connected to the back-rest tubes via rotating sleeves. The upper front crossed tubes, the middle front crossed tubes, and the lower front crossed tubes are connected end to end. The upper front crossed tubes are connected to the front vertical tubes via sliding sleeves. The connection points of the upper front crossed tubes and the middle front crossed tubes are connected to the lower ends of the front vertical tubes, and the lower front crossed tubes are connected to the lower ends of the back-rest tubes via U-shaped hinging elements. The table surface fabric is wrapped over the front vertical tubes and rear vertical tubes via lid positioning sheaths, and the chair fabrics are wrapped over the seating frame tubes and back-rest tubes.

The combination of one table and two chairs for two persons according to this invention has the following advantages and features: reasonable design, luxurious contour, elegance, convenience in use, and comfort for sitting and resting. The combination can be used by two persons because it includes two folding chairs and one folding table. The folding table may be arranged in several configurations and the width of the table can be varied if needed, because the folding table uses a structure of crossed tubes. A linkage means is used for the folding structure, thus resulting in a stable construction and desirable rigidity. The table has numerous applications, and on the table can be placed, for example, beverages, articles, books, and newspapers.

DETAILED DESCRIPTION OF THE INVENTION

In the following discussion, the present invention is further described in conjunction with the drawings.

Figure 1:
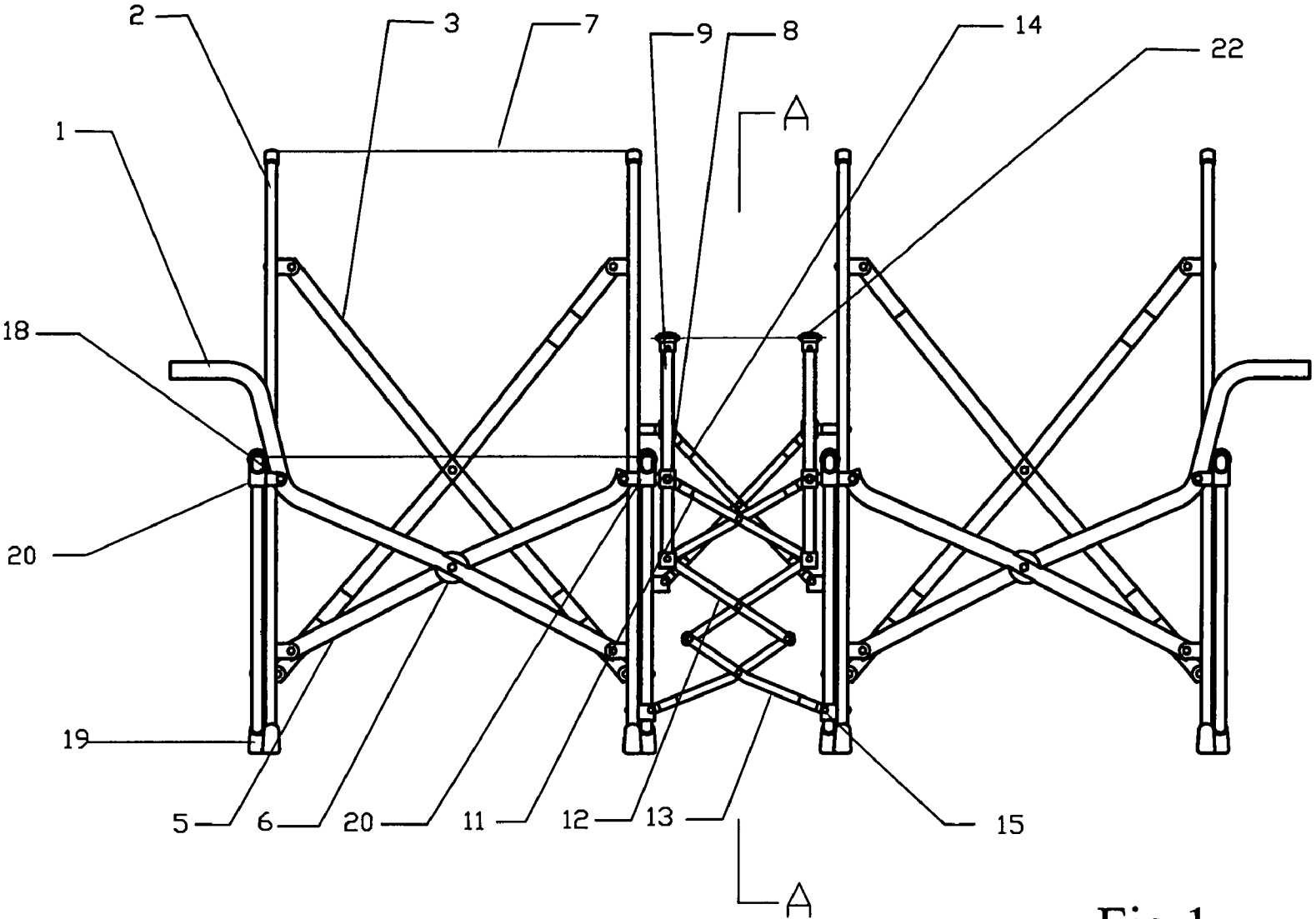
FIG. 1 is a schematic view of the structure of the combination of one table and two chairs for two persons according to one embodiment of this invention.
Figure 2:
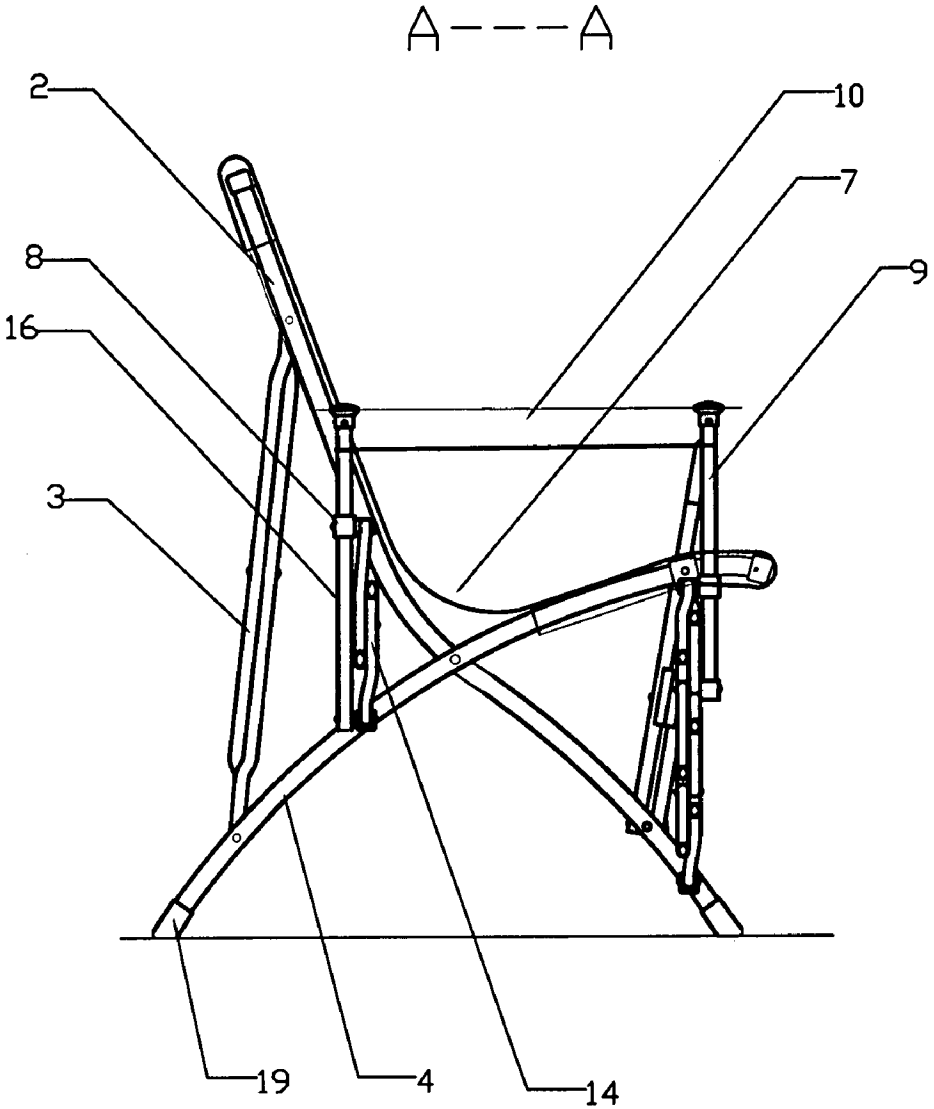
FIG. 2 is a cross-sectional view of the structure along the line A—A of the combination of one table and two chairs for two persons according to this invention.
Figure 3:
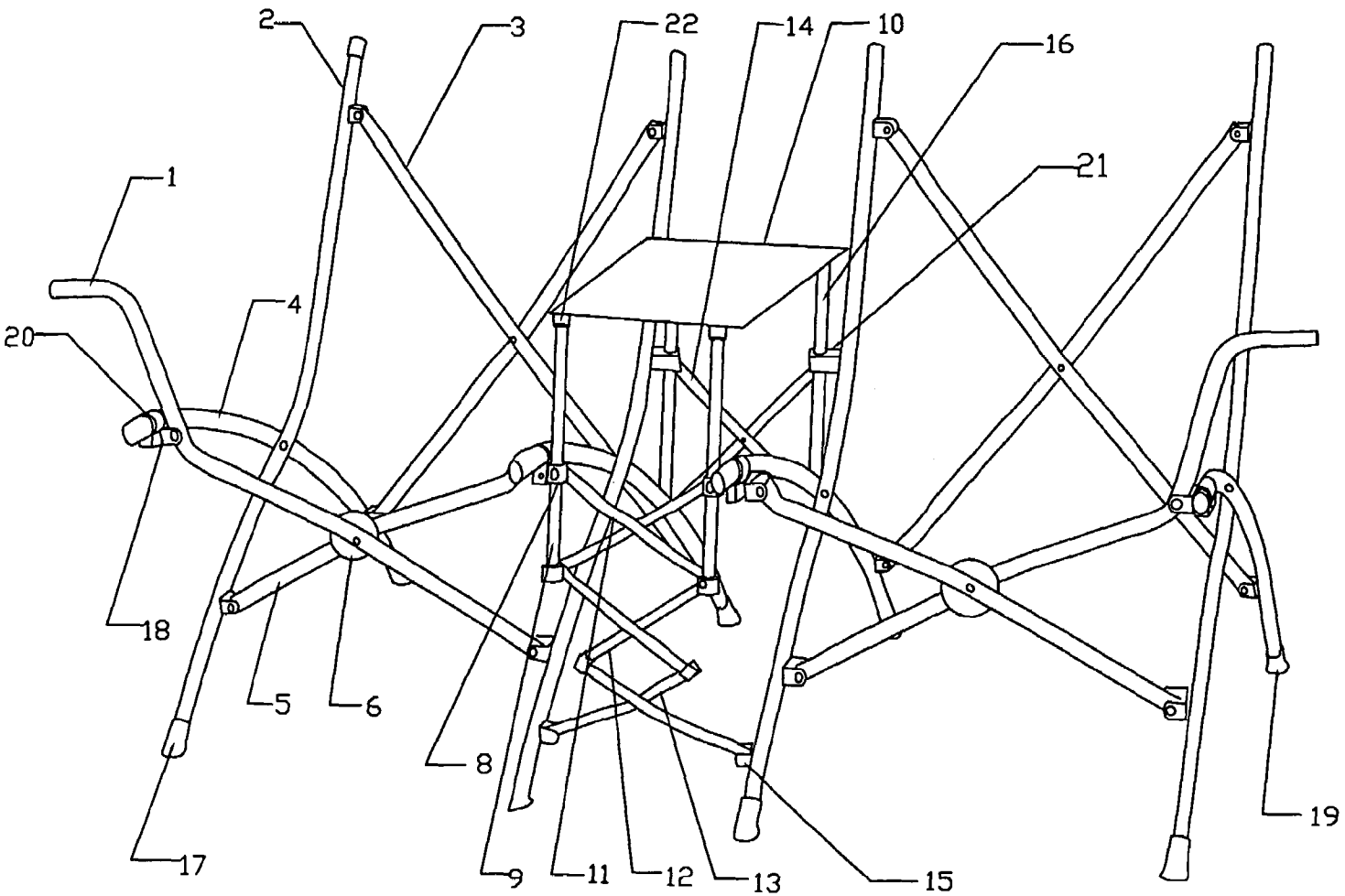
FIG. 3 is an amplified view of the structure of the combination of one table and two chairs for two persons according to this invention.
Figure 4B:
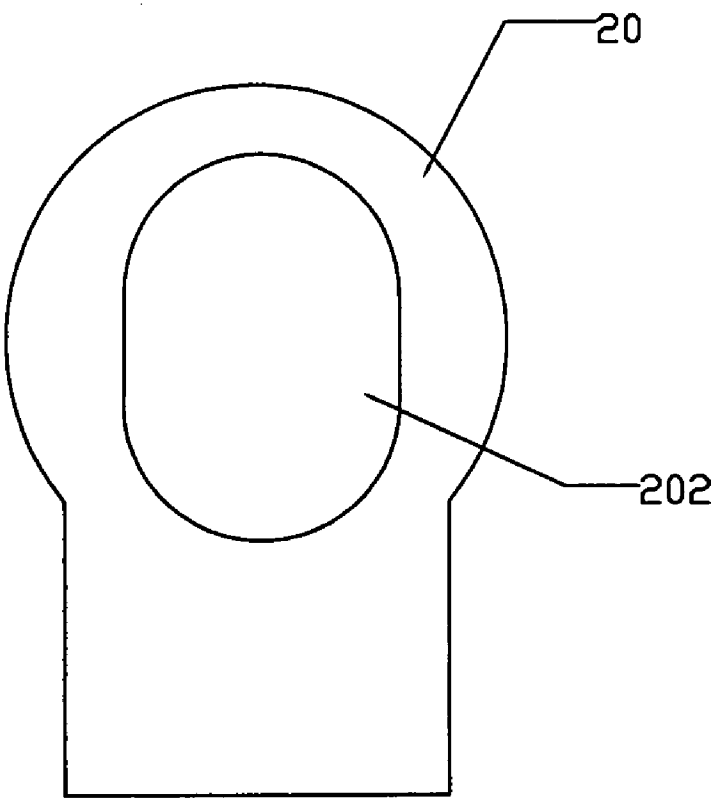
FIGS. 4A and 4B are schematic views of the fixing element in the combination of one table and two chairs for two persons according to this invention.
Figure 4A:
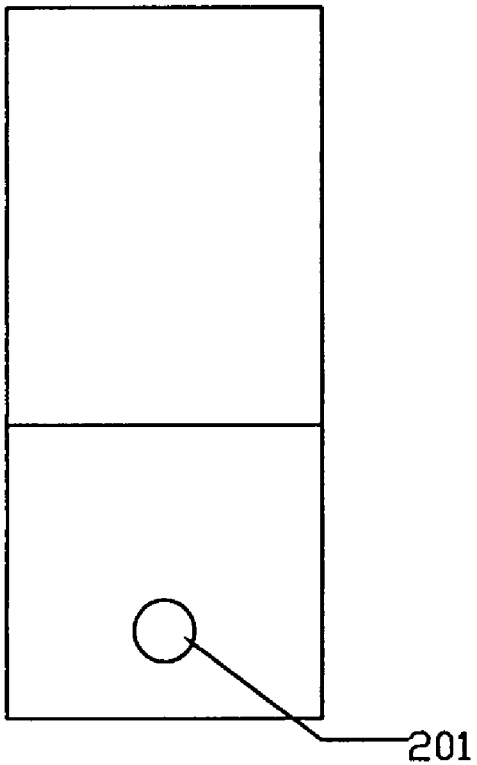

Referring to FIGS. 1 through 3, the combination of one table and two chairs for two persons of this invention includes two folding chairs and one folding table, the two folding chairs being disposed at both sides and the folding table being disposed between the two chairs. The two folding chairs are consistent in structure, with the framework of each folding chair being symmetrical at the left and right sides except for the arm tubes. Each of the folding chairs includes arm tubes 1, front crossed tubes 5, two back-rest tubes 2, two seating frame tubes 4, rear crossed tubes 3, and chair surface fabrics 7. The folding table includes two front vertical tubes 9, front crossed tubes, two rear vertical tubes 16, rear crossed tubes 14, and a table surface fabric 10. The front crossed tubes may be arranged in several groups, including upper front crossed tubes 11, middle front crossed tubes 12, and lower front crossed tubes 13, which are hinged to one another. The arm tubes 1 are connected cross-wise to the front crossed tubes 5, and at the crossed connection point and between the tube fittings a pair of reinforced blocks 6 is provided.

Figure 7B:
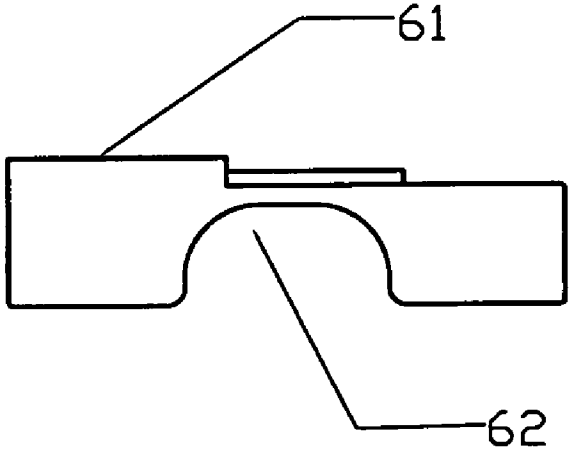
FIG. 7B is a side view of the reinforced blocks in the combination of one table and two chairs for two persons according to this invention.
Figure 7A:
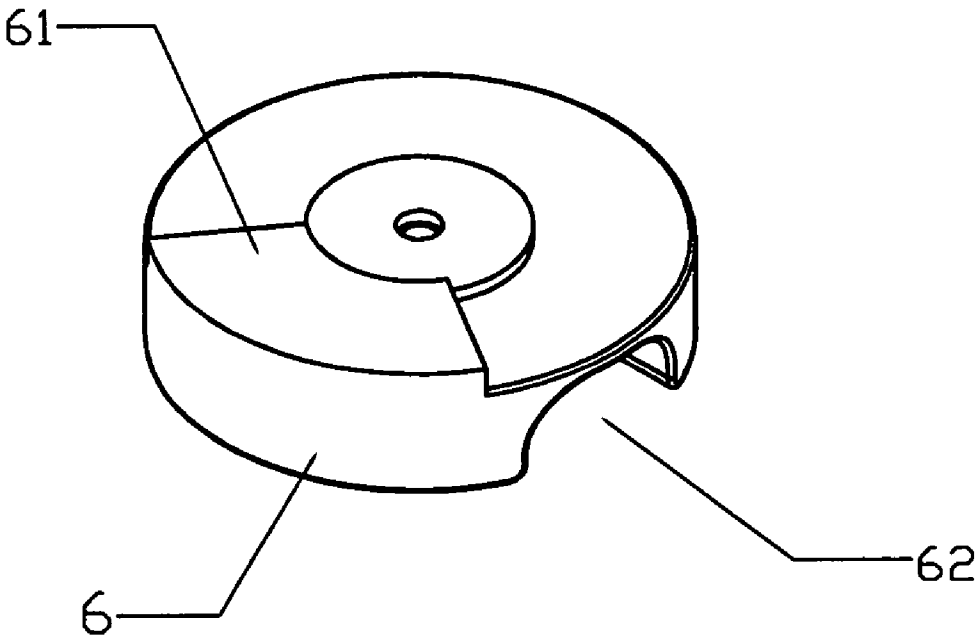
FIG. 7A is a schematic view of the stereoscopic structure of the reinforced blocks in the combination of one table and two chairs for two persons according to this invention.

Referring to FIGS. 7A and 7B, each of reinforced blocks 6 is lid-shaped, a rivet hole is provided at the center thereof a projection 61 is provided on the upper end thereof, and a positioning recess 62 is provided on the lower end of the lid-shaped border. The positioning recess 62 is fixed to the inside of the fitting at the crossed connection point, thus allowing the projections 61 of the two reinforced blocks to be disposed oppositely. The rivet hole at the reinforced block is connected to the rivet hole at the crossing point of the fitting via a rivet. When the arm tubes 1 and the front crossed tubes 5 are fully unfolded along with the entire chair, the edges of the projections 61 for the two reinforced blocks 6 will collide with one another, thus fastening the supports and helping to provide enhanced support.

Figure 5:
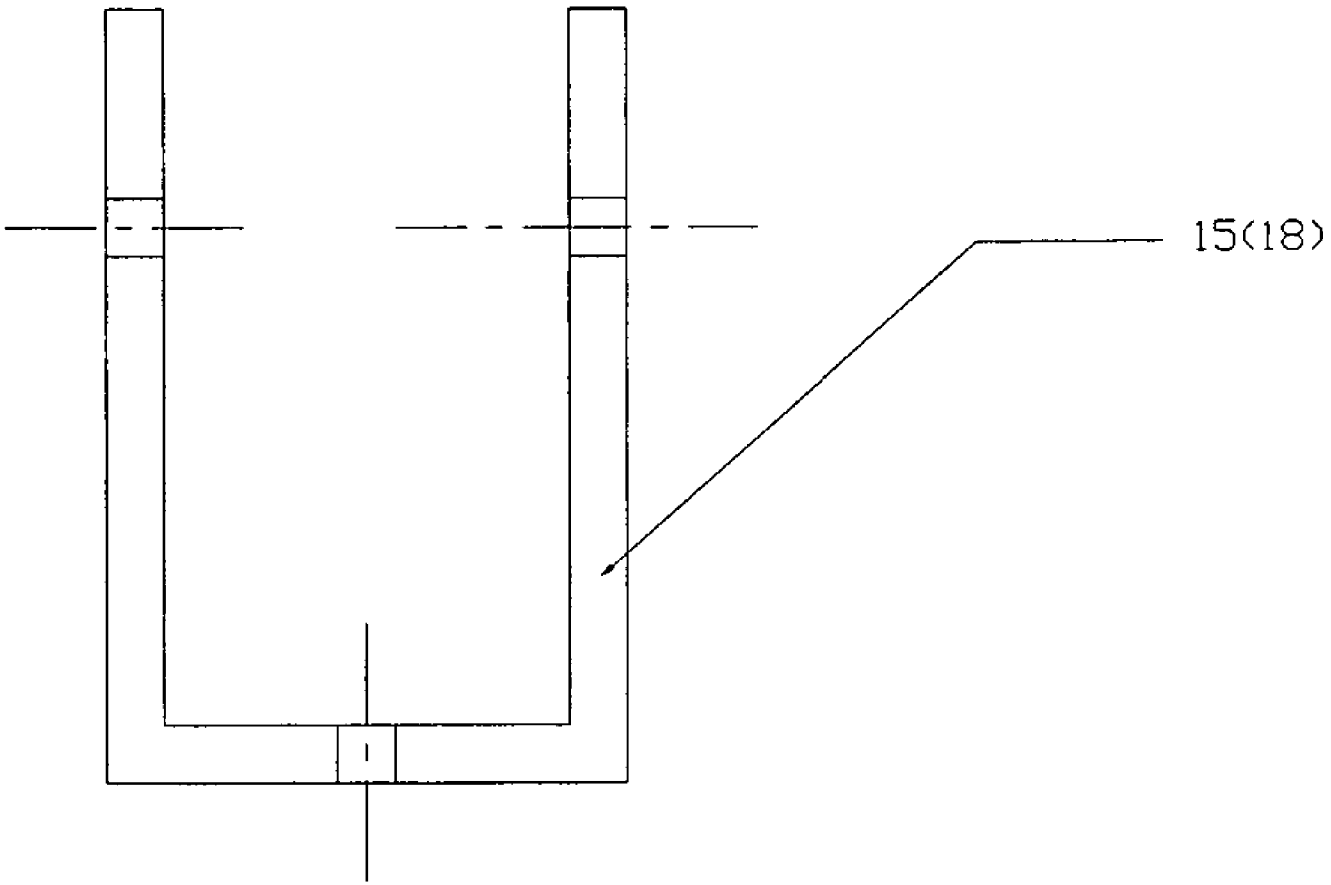
FIG. 5 is a schematic view of the U-shaped hinging element in the combination of one table and two chairs for two persons according to this invention.
Figure 6:
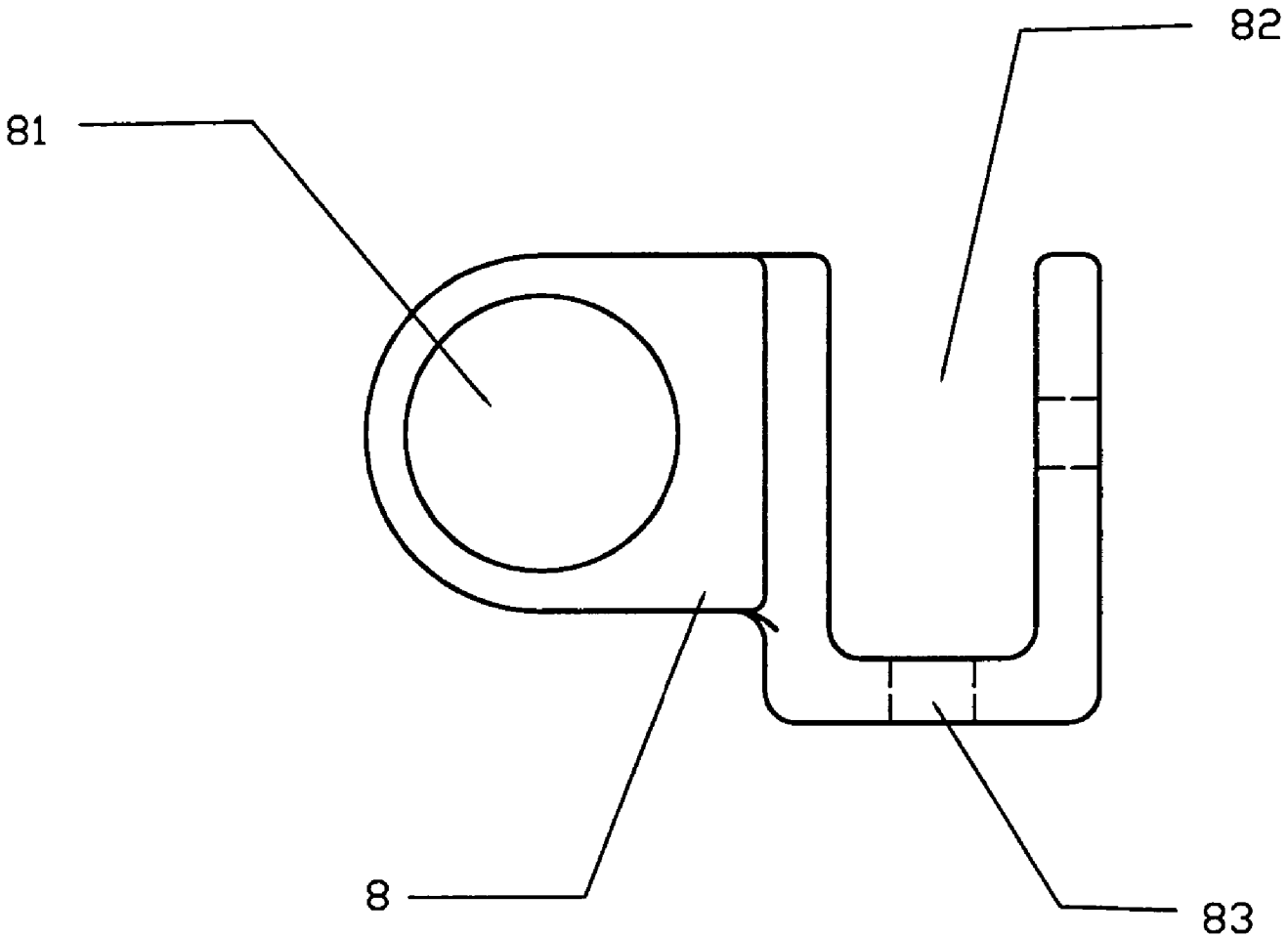
FIG. 6 is a schematic view of the sliding sleeve in the combination of one table and two chairs for two persons according to this invention.

Referring to FIGS. 1, 3, 4A, and 4B, the seating frame tube 4 is connected cross-wise to the back-rest tube 2, and the front crossed tube 5 is connected to the back-rest tube 2 via a U-shaped hinging element (not numbered). The arm tube 1 is riveted to the U-shaped groove of the U-shaped hinging element 18, at the top of which a rivet hole is connected to the rivet hole 201 on the fixing element 20. The front end of the seating frame tube 4 is sleeved in the fixing hole at the fixing element 20, and at the lower end of the seating frame tube 4 is provided shoe 19. At the lower end of the back-rest tube 2 is provided shoe 17. The upper portion of the rear crossed tube 3 is connected to the back-rest tube 2, and the lower end thereof is connected to the seating frame tube 4, forming left and right chairs. In the middle portion there are provided upper front crossed tubes 11, middle front crossed tubes 12, and lower front crossed tubes 13, with these tubes being connected end to end. The upper ends of the upper front crossed tubes 11 are riveted with the U-shaped groove 82 in the sliding sleeve 8, and the fixing hole 83 of the sliding sleeve 8 is riveted to the hole 201 on the fixing element 20, which is fixed on the seating frame tube 4. The structure of the sliding sleeve 8 is shown in FIG. 6. The connection point of the upper front crossed tubes 11 and the middle front crossed tubes 12 is hinged with the lower end of the front vertical tube 9, and the front vertical tube 9 is fitted in the sliding hole 81 of the sliding sleeve 8 and is slidable up and down. The lower crossed tubes 13 are riveted to the U-shaped grooves of the U-shaped hinging elements 15. The structure of the U-shaped hinging element 15(18) is shown in FIG. 5. In the case of U-shaped hinging element 15, a rivet hole at the top of the U-shaped hinging element 15 is connected to the lower end of the back-rest tube 2. The lower ends of each of the rear crossed tubes 14 is riveted to the U-shaped groove of the U-shaped hinging element (not numbered) at the lower portion of each of the seating frame tubes 4, and the upper end of each of the rear crossed tubes 14 is connected to the U-shaped groove of the sliding sleeve 8 fixed at the upper portion of the back-rest tube 2. The lower portion of each of the rear vertical tubes 16 is riveted to the lower end of each of the rear crossed tubes 14, and is fitted in the sliding hole 81 of the sliding sleeve 8, allowing the rear vertical tubes 16 to be slidable up and down. The table surface fabric 10 is wrapped over the front vertical tubes 9 and the rear vertical tubes 16 via the lid positioning sheath 22. The chair surface fabric 7 is wrapped over the seating frame tube 4 and the back-rest tube 2. The chair surface fabric 7 may use any suitable soft cloth. At the sides of the table there may be provided article storage bags (not shown), and on the table surface can be placed cups, plates, books, etc. The U-shaped hinging element may be made of a plastic material, or any other suitable material.

To use the combination of one table and two chairs for two persons, one can simply hold the arms of the two folding chairs with both hands and pull the arms apart toward both sides, so that the folding table between the two folding chairs will unfold accordingly for use. To fold the combination of one table and two chairs for two persons, one can simply hold the arms at both sides of the folding chairs, and draw the arms inward and compress the chair crossed support tubes and the table crossed tubes, so that the combination of one table and two chairs for two persons will be folded together, and is ready to be put into a bag for carrying.

The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

The invention claimed is:

1. A combination of one table and two chairs for two persons, comprising:

two folding chairs and one folding table, wherein said folding table is disposed between said folding chairs, each of said folding chairs includes an arm tube, a front crossed tube, two back-rest tubes, two seating frame tubes, rear crossed tubes, and a chair surface fabric, said folding table includes front vertical tubes, front crossed tubes, rear vertical tubes, rear crossed tubes, and a table surface fabric, said front crossed tubes of said folding table including upper front crossed tubes, middle front crossed tubes, and lower front crossed tubes, and wherein each of said arm tubes is connected cross-wise to one of said front crossed tubes, at a crossed connection point a pair of reinforced blocks is provided, each of said seating frame tubes is connected cross-wise to one of the back-rest tubes, each of said arm tubes is connected to a front end of one of said seating frame tubes via a U-shaped hinging element, an upper portion of each of said rear crossed tubes is connected to one of said back-rest tubes, and a lower portion of each of said rear crossed tubes is connected to one of said seating frame tubes, a middle portion of each of said front vertical tubes is connected to one of said seating frame tubes via a sliding sleeve, each of said rear vertical tubes is connected to one of said back-rest tubes via a sliding sleeve, said upper front crossed tubes, said middle front crossed tubes, and said lower front crossed tubes are connected end to end, said upper front crossed tubes are connected to said front vertical tubes via sliding sleeves, a connection point of said upper front crossed tubes and said middle front crossed tubes is hinged with a lower end of one of said front vertical tubes, and said lower front crossed tubes are connected to said back-rest tubes via said U-shaped hinging element.

2. The combination of one table and two chairs for two persons according to claim 1, wherein said table surface fabric is wrapped over said front vertical tubes and said rear vertical tubes via a lid positioning sheath.

3. The combination of one table and two chairs for two persons according to claim 1, wherein said chair surface fabric is wrapped over said seating frame tubes and said back-rest tubes.

4. The combination of one table and two chairs for two persons according to claim 1, wherein each of said reinforced blocks is lid-shaped, at a center thereof is provided a rivet hole, on an upper end thereof is provided a projection, and on a lower end of a lid-shaped border is provided a positioning recess.

5. The combination of one table and two chairs for two persons according to claim 4, wherein each of said reinforced blocks is disposed at the crossed connection point of one of said arm tubes and one of said front crossed tubes.

6. The combination of one table and two chairs for two persons according to claim 1, wherein each of said reinforced blocks is disposed at the crossed connection point of one of said arm tubes and one of said front crossed tubes.

7. The combination of one table and two chairs for two persons according to claim 1, wherein said sliding sleeve includes a sliding hole, and a U-shaped groove is provided axially parallel to said sliding hole.

* * * * *